US007841289B1

(12) United States Patent
Schanz

(10) Patent No.: US 7,841,289 B1
(45) **Date of Patent: *Nov. 30, 2010**

(54) WATER LEVEL AND/OR SUB SURFACE WATER TRANSPORTER/STORAGE SYSTEMS FOR LIQUIDS AND SOLIDS SIMULTANEOUSLY OR IN SINGLE CARGO

(76) Inventor: Richard W. Schanz, 1120 Wesley Powell Dr., St. George, UT (US) 84790

( * ) Notice: Subject to any disclaimer, the term of this patent is extended or adjusted under 35 U.S.C. 154(b) by 0 days.

This patent is subject to a terminal disclaimer.

(21) Appl. No.: 12/589,349

(22) Filed: Oct. 22, 2009

(51) Int. Cl.
*B65D 88/78* (2006.01)

(52) U.S. Cl. ..... 114/257; 114/256

(58) Field of Classification Search ..... 114/256, 114/257

See application file for complete search history.

(56) References Cited

U.S. PATENT DOCUMENTS 2,371,404 A 3/1945 Mumford
3,648,635 A 3/1972 Hashemi
3,902,440 A 9/1975 Anders
3,999,499 A 12/1976 Kitabayashi
4,108,101 A 8/1978 Schirtzingel
4,227,478 A * 10/1980 Preus ..... 114/256
4,399,765 A * 8/1983 Alkner et al. ..... 114/256
5,354,151 A 10/1994 Giannesini
5,899,637 A 5/1999 Blanchard et al.
6,260,501 B1 * 7/2001 Agnew ..... 114/257
6,796,379 B1 9/2004 Martin
7,185,705 B2 3/2007 Fontana
7,500,442 B1 3/2009 Schanz

* cited by examiner

*Primary Examiner*—Ed Swinehart
(74) *Attorney, Agent, or Firm*—Marcus G. Theodore

(57) ABSTRACT

A lightweight towed submersible water transporter and storage system for liquids and solids, which employs a streamlined towable hull with exterior ballast/buoyancy cells and optional air and liquid storage bladders used not only to adjust buoyancy, but to allow the simultaneous transport and storage of different solids and liquids.

19 Claims, 4 Drawing Sheets

WATER LEVEL AND/OR SUB SURFACE WATER TRANSPORTER/STORAGE SYSTEMS FOR LIQUIDS AND SOLIDS SIMULTANEOUSLY OR IN SINGLE CARGO

BACKGROUND OF THE INVENTION

1. Field of Invention

The present invention relates to water level and/or subsurface or submersible water transport and storage systems. In particular, it relates to a lightweight towed submersible water transporter and storage system for liquids and dense products, such as grains, sulfur, Portland cement, etc., hereinafter referred to as solids, which optionally employs internal lateral support curtains, and exterior ballast/buoyancy cells positioned to act as a pneumatic fender along a lightweight longitudinally reinforced hull with optional air and liquid storage bladders used not only to adjust buoyancy, but to allow the simultaneous transport of different solids and liquids for unloading or storage at a delivery point or on a back haul without cross-contamination.

2. Description of Related Art

Various submersible transport and storage systems are known in the art. This application is exclusive from applicant's U.S. Pat. No. 7,500,442 issued Mar. 10, 2009, entitled "Submerged Transporter and Storage System for Liquids and Solids". Other transport storage systems, such as Blanchard et al, U.S. Pat. No. 5,899,637 issued May 4, 1999 provides an offshore production and storage facility and method of installing the same employing a concrete barge having oil storage tanks secured to its deck that is towed to an oil production site where it is sunk to the sea bottom. It is of heavy construction and is towed on the water until sunk in position via controlling the pressure of air in the storage tanks. It is not designed as a lightweight backhaul carrier to reduce transportation costs, when empty and shipped to the site.

Agnew, U.S. Pat. No. 6,260,501 issued Jul. 17, 2001 discloses a submersible apparatus for transporting compressed gas. It has a plurality of spools, each having a central bore and a long continuous length of relatively small diameter line pipe for holding compressed natural gas wound about each spool with an inner end terminating in the bore and an outer end terminating at the outer surface of the spool stored within a tank having a thin housing to store the spools vertically therein. The tanks are usually towed underwater at a depth via ballast means, and the spools are surrounded by a non-corrosive fluid to support a pressure differential to greatly reduce the structural requirements of the housing.

Kitabayashi, U.S. Pat. No. 3,999,499 issued Dec. 28, 1976 discloses a surface vessel driven and controlled submarine cargo transport. The device employs a cylindrical tank-like submarine hull, which acts as a cargo carrier, and carries a propulsion element, which is power driven through a power supply from a surface vessel through a power transport member interconnection. Ballasting means are included to control the elevation such that the vessel stays near the surface.

Schirtzingel, U.S. Pat. No. 4,108,101 issued Aug. 22, 1978 discloses a towing system for cargo containers using a semi-rigid boom extending from the stern of a towing vessel to hold the nose of the container at a level below the wake of the towing vessel.

Giannesini, U.S. Pat. No. 5,354,151 issued. Oct. 11, 1994 discloses a system for loading at sea employing a submersible conveying structure and anchoring device, which includes a loading system adapted to lie on a sea bed. A buoy holds the conveying structure hear the surface, unless there is ice or other surface obstructions, wherein the buoy and conveying structure is pulled below the surface until the surface obstructions are no longer present.

Mumford, U.S. Pat. No. 2,371,404 issued Sep. 15, 1942, discloses a towable submersible container containing ballonettes to adjust buoyancy. The container has bulkheads forming a central cargo hold and two end compartments containing the ballonettes to adjust the buoyancy. It may include an expandable rubber liner for hull reinforcement.

Hashemi, U.S. Pat. No. 3,648,635 issued Mar. 14, 1972 discloses a marine transport for moving bulk quantities of goods in a submarine hull having ancillary surface accommodations for a crew connected to the submarine via an elongated fin extending to the surface. It is power driven with the submarine hull cargo container submersible to avoid ice and other surface obstructions, which could damage the hull.

Anders, U.S. Pat. No. 3,902,440, issued Sep. 1, 1975, is an underwater vehicle which may be towed or self powered to travel beneath the water to avoid obstructions and aid in ocean mining and underwater exploratory activities. It has a submerged weight of the frame controlled by buoyancy tanks to maintain the vehicle at the desired bottom elevation.

Martin, U.S. Pat. No. 6,796,379 issued Sep. 28, 2004 is drilling waste handling method and apparatus for storage and transport of drilling waste. A number of storage containers are anchored to the sea bed by means of anchors and cables. These containers are marked with buoys and have adjustable buoyancy. Drilling waste is macerated on board a drilling vessel and pumped via conduits into the containers. Once the containers are full, they are towed to an onshore waste recycling facility and then returned to the drilling vessel for reuse. Usually the containers employ internal agitators to rotate the containers in response to sea currents.

Fontana, U.S. Pat. No. 7,185,705B2 issued Mar. 6, 2007 discloses a system and method for recovering return fluid from sub sea well bores using submersible containers, which are expandable or collapsible, such that they inflate or expand when filled with fluid. Alternatively, they are relatively inflexible vessels. Buoyant members provide a buoyancy force for raising the transport device towards the surface once the drilling operation is completed. It allows for the recovery of return fluids for treatment and reuse. Fluids are typically transported and collected via a stand pipe connecting the surface operations with the subsurface containers.

None of the above references provides a lightweight towed submerged water transporter and storage system for liquids and solids, which optionally employs internal lateral support curtains, and exterior ballast/buoyancy cells positioned to act as a pneumatic fender along a lightweight longitudinally spine reinforced hull with optional air and liquid storage bladders used not only to adjust buoyancy, but to allow the simultaneous transport of different solids and liquids for unloading or storage at a delivery point or on a back haul without cross-contamination.

SUMMARY OF THE INVENTION

The present invention comprises a submersible transporter and storage system for liquids and/or solids. It provides a relatively inexpensive towable container system, which allows transfer or storage of products in a container by water. Specifically, it comprises an inflatable loadable hull preferably of ellipsoid shape with two opposite towing attachment ends, a top, a fill port, an emptying port and an air chamber for stabilization. An ambient liquid port may be included to selectively allow surrounding fluids to enter and fill the hull to equalize pressure to provide rigidity for transport or storage.

The hull is constructed of a flexible semi-rigid material to hold either solids or liquids. It has a top with an air chamber, which when filled with air, keeps the transporter upright and level during transport. A cordlike connecting spine, such as a cable, rope, chain, etc. passing through the transporter hull connects the hull towing attachment ends to provide longitudinal reinforcement to prevent longitudinal distortion during towing transport or towing more than one unit. If high towing speeds are to be encountered, deflection means for protection of the hull at its forward towing end may be included to deflect water around the front of the hull to prevent its distortion.

In one preferred embodiment, the hull has at least one bladder liner including openable inspection manholes for manual inspection of the hull and bladder liners.

The optional bladder liner is included for transport of different products in the same hull. The bladder liner and top air chamber each has a fill port and emptying port, which when filled with air also keeps the transporter upright and level during transport. The bladder liner enables different products to be transported or stored without cross contamination. The liner also avoids the need to clean out the unit when changing products making it easier to have a back haul. Liquids, such as petroleum products, slurry, water, potable and non-potable, acids, sewage, etc. and certain solids, such as grains, Portland cement, etc. may be transported or stored in the same transporter. If used for a single purpose without need for a loaded back haul, the bladder liner may be omitted.

The flexible bladder liner is constructed of a material to hold liquids and injected air for buoyancy. A cable spine passes through the bladder to connect the hull towing attachment ends to provide longitudinal support to resist distortion of the hull and bladder liner during towing.

Filling means, such as hoses and lines and pipes, are associated with the hull and bladder liner fill ports and emptying ports and a loading station to selectively fill the hull and bladder liner respectively with solids and liquids from the surface. Air lines also inject air into the top air chamber of the bladder to keep the transporter upright and level to provide the required buoyancy for the submerged transporter to be towed at a desired depth.

A controller, such as a computer valve system is mounted on the loading station and is associated with the filling means and ambient liquid port to control the fill rate and liquid/solids cargo composition for transport by the transporter. The controller adjusts the load composition, capacity, and buoyancy to provide the required rigidity to tow the transporter at a desired speed and depth during transport mode. When docked, the controller further controls the storage and unloading conditions in a storage and unloading mode. The contents within submerged transporter and storage system for liquids and solids should not be held under pressures significantly exceeding ambient pressure. Loading to about 98% of maximum capacity is recommended. This will allow the submerged transporter and storage system for liquids and solids to have a slight degree of flexibility which will reduce the possibility of external damage and extend the usable life of the unit. If an empty transporter is to be moved, collapsing can be prevented by loading the transporter hull or bladder during transport with water for ballast and rigidity to prevent hull damage or collapse.

Preferably stabilizing fins also controlled by the controller are attached to the exterior of the hull to interact with a hull slip stream to alter the depth and the angle of the transporter to provide stability during towing. This is particularly required to insure that the wake of the towing vessel does not interfere with the transporter. Also, when towing where surface debris is likely to be encountered, the transporter is dragged beneath the surface to prevent surface obstruction contact damage.

The hull is preferably constructed of rubber or plastic coated cord or canvas with a plasticized lining. If required, the hull may be wound with cord to provide a rigid construction similar to that of automobile tires. This provides a collapsible hull, which is lightweight for overland or air transport to a job sight.

The bladder liner is constructed of rubber or plastic coated cord or canvas resistant to fluids and air and is also collapsible, when empty for light weight transport. The controller adjusts the amount of air filling the bladder liner and/or air chamber to compensate for the weight of the materials and liquids being transported to provide the required buoyancy for towing.

After transport, the products in the transporter may be unloaded for storage into the storage system or other facilities or vessels. As the bladder liner is filled, the added contents displace water and/or air in the container. Air is then injected into the container to balance the weight of the load placed in the bladder liner with a combination of water and air, which is monitored manually or by a controller, such as a computer, at the loading station, to keep the submerged transporter and storage system at approximately water level or a desired depth. The same principle applies while unloading so that water is drawn into the bladder liner or hull to off-set the unloaded material. Therefore, during loading or unloading, the buoyancy is adjustable depending upon the relative weight of the stored products. For mixed product transport or storage, the transporter bladder liner keeps the items independent of each other eliminating the possibility of cross contamination. Any water displaced is preferably uncontaminated and released into the surrounding water which eliminates pollution concerns. For example, potable water, while being loaded at one point displacing sea water in the container, is towed to another location where it is off loaded while sea water is taken back in to balance the container.

The submerged transporter and storage system for liquids and solids thus provides a means for portability of high volumes of product with out tying up a ship, for example, while oil is being pumped from the earth or being loaded or unloaded. Set up of the empty storage units is accomplished by shipping them to their destination by truck and/or air and placing them in position by a crane.

The submerged transporter and storage system thus provides a relatively inexpensive portable container which can be filled at the source and delivered to a destination point. Separating the products with a bladder liner allows different products to be transported or stored without cross contamination. Not having to clean out the unit when changing products makes it easy to have a back haul. Liquids, such as, petroleum products, slurry, water, both potable and non-potable, acids, sewage, etc. and certain solids maybe transported or stored.

The submersible transporter and storage system for liquids and solids is particularly suited to meet the increased activity of shoreline storage use and the advent of offshore drilling plus the occasional disastrous accidental spillage of petroleum products. The escalating price of oil makes drilling further off shore a reality so the piping of crude oil to shore for refining is not practical requiring the need for a towing transport. Rising sea levels and the expansion of shorelines further increases the demand for such units. Also, in the event of natural disasters, such as, earthquakes, cyclones, floods, and tsunamis the submerged transporter and storage system for liquids and solids provides an important source for delivering and storing water or fuel to the disaster site.

In other embodiments, the submersible transporter and storage system is adapted for transport or oil spill cleanup in either open seas or inland water channels. For use on rivers and inland waters, often shallow drafts are required. For example, the Coast Guard requires river shippers to maintain a draft of nine feet. This can be accomplished by adding an internal lateral support curtain within the hull, which limits the amount of loading to insure that the draft is maintained, when filled. The lateral support curtain is made of the same material as the hull exterior. However, it does not have to be as thick. It usually includes openings for the passage of workers for inspections and repairs.

To maintain hull integrity and to add stability, longitudinal ballast/buoyancy cells are mounted along the hull to act as a pneumatic fender to reduce or eliminate damage or punctures to the main container, thus giving it a double hull advantage. These ballast/buoyancy cells are usually separated into compartments (each about 25' long, depending on the length of the entire hull unit) for added safety in the event one becomes punctured. Each can be inflated with either water or air or both via lines controlled by electronic valves in the service tower. The regulation of the volume of air or water to be installed in each cell compartment usually is controlled by computers on a towing vessel or an attending docking station to maintain the system at the required water level as specified by the operators.

Increased stability is afforded by the air chamber. Another embodiment, where desired, has a modification to the service tower with an opening leading directly into the hull where the proper depth of the transporter/storage unit is regulated via the air chambers and cells. For petroleum spillage, the contaminated water would be allowed to enter and fill the transporter via gravity. Any scavenger water that enters while filling can be removed from the hull via the empty port and, if not advisable to return to the body of water it came from, can be put into the bladder liner via the bladder liner fill and empty ports for later removal. In the event the transporter/storage units are for single purpose use the Bladder Liner may be eliminated as discussed.

DESCRIPTION OF THE ILLUSTRATED EMBODIMENTS

Figure 1:
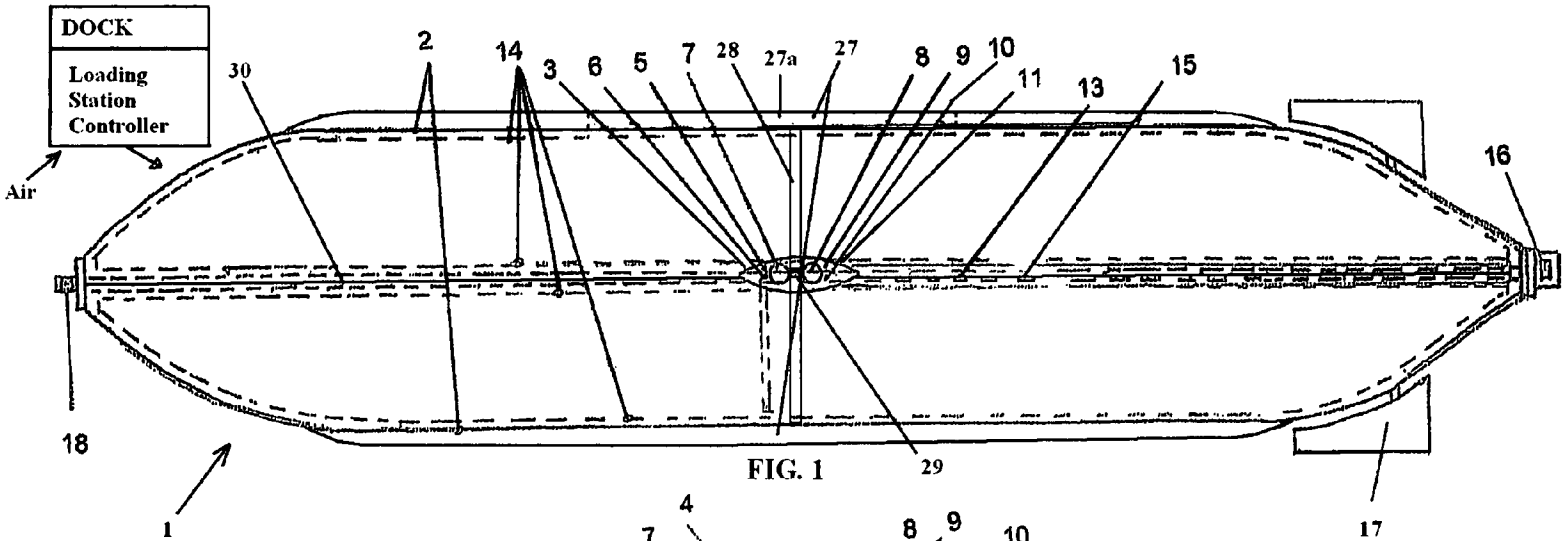
FIG. 1 is a top view of a water level and/or subs surface transporter embodiment of the invention.
Figure 2:
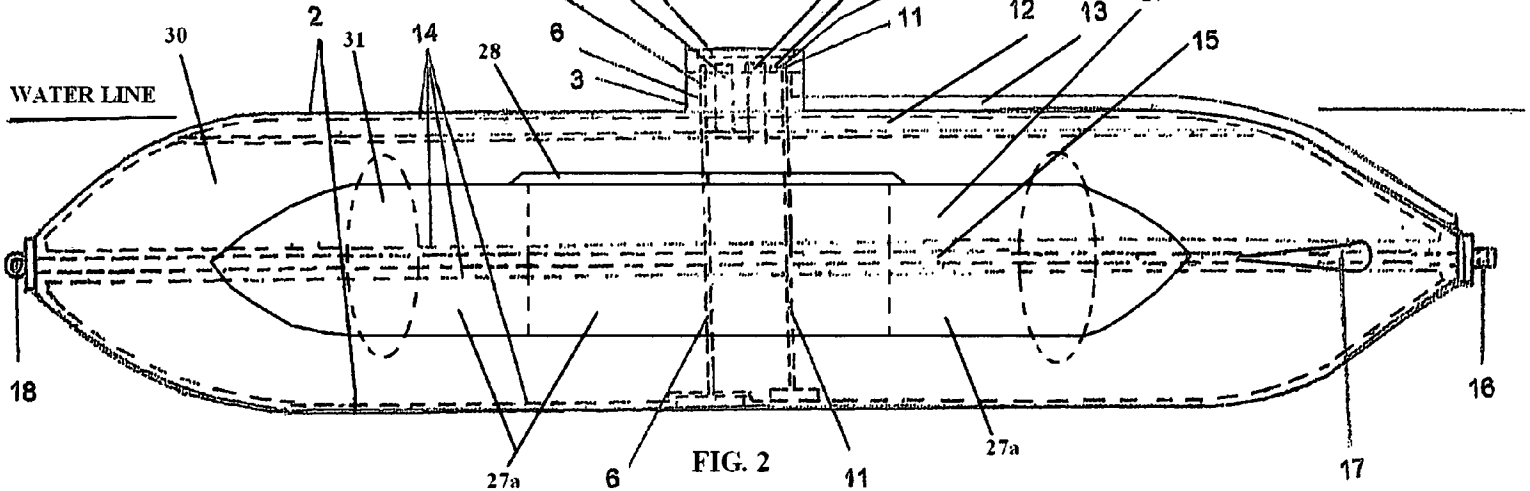
FIG. 2 is a side view of the embodiment shown in FIG. 1.
Figure 3:
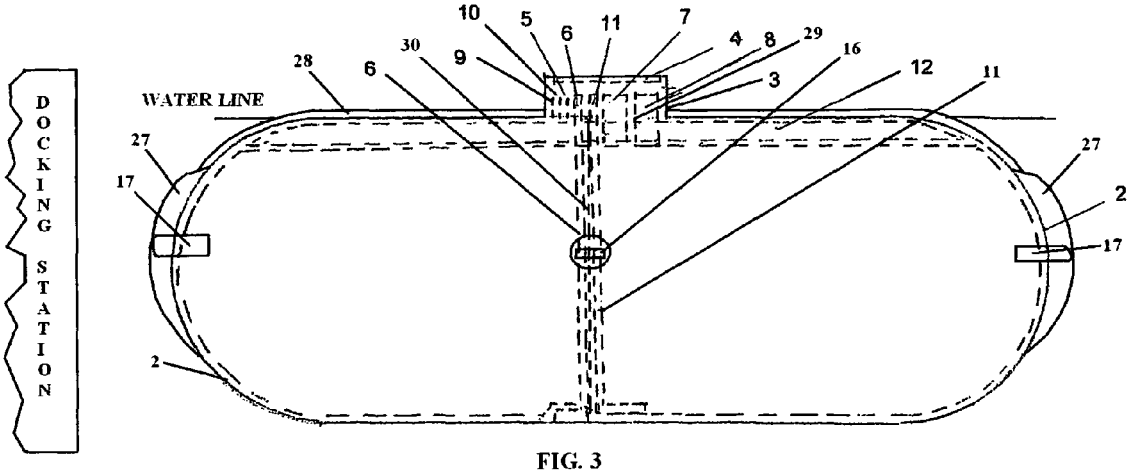
FIG. 3 is a front view of the embodiment shown in FIG. 1.

The transporter 1 is shown in the attached drawings. FIG. 1 is a top view of a preferred embodiment of the invention. The parts list below provides the numbers of the parts of the invention shown in the drawings:

1. Transporter
2. Hull
3. Service Tower
4. Service Tower Cover
5. Hull Air Port
6. Hull Liquid Fill and Empty Port
7. Hull Manhole (Solids Fill and Empty Port)
8. Bladder Liner Manhole (Solids Fill and Empty Port)
9. Bladder Liner Air Port
10. Air Chamber Port
11. Bladder Liner Liquid Fill and Empty Port
12. Air Chamber
13. Air Supply From Tow Boat
14. Bladder Liner
15. Rust Proof Steel Cable
16. Front Tow
17. Stabilizing Fin
18. Towing Eye
19. Hitching Guide
20. Automatic Hitch
21. Hitch Positioner
22. Hydraulic Hitch Arm Positioner
23. Cable Drum
24. Tow Boat
25. Tow Boat Cable Well
26. Tow Cable
27. Ballast/buoyancy cells
27*a*. Ballast/buoyancy cell compartments
28. Air/Water Inflation line
29. Control Valve
30. Lateral support curtain
31. Inspection passageway The transporter 1 shown in FIGS. 1, 2, and 3 is submarine in shape. Its length and diameter may vary as the user may require. For illustration purposes, the unit shown in FIG. 1 is approximately 175' long by 40' in diameter. The hull 2 of the transporter 1 is made of 3 or 4 ply rubber or plastic coated cord or canvas or a combination of both and may be plasticized lined. A service tower 3 has a cover 4 with hull air ports 5, a hull liquid fill and empty port 6 and a hull manhole 7, or bladder manhole 8. These solids can be loaded through their respective manholes 7, 8 by vacuum suction, which can be used to fill and empty solids into the hull.

The hull 2 has an interior bladder liner 14 with a corresponding bladder liner air port 9, an air chamber port 10, and a bladder liquid fill and empty port 11. The air chamber port 10 leads into an air chamber, which is filled with air to insure the transporter 1 remains upright and level during use. A cordlike spine, shown as a rust proof steel cable 15, connects a front tow 16 affixed to the hull 2 and a towing eye 18 affixed to the other end of the hull 2 to provide longitudinal structural reinforcement of the transporter 1 to minimize hull 2 distortion during towing. This rust proof steel cable 15 thus acts as the spine of the transporter 1. It provides longitudinal rigidity yet allows flexibility and preferably is bendable to collapse when the hull is collapsed for transport.

The bladder liner 14 is made of 2 or 3 ply rubber or plastic coated cord or canvas or a combination of both and may be plasticized lined. The bladder liner 14 is water tight and sealed to the cable 15 at the front end and the rear end or may encase the cable 15 as shown. The air chamber 12 and the bladder liner 14 are designed to be manually controlled individually with compressed air supplied by the tow boat 24 shown in FIG. 6, or by a power station (not shown) where the transporter 1 is docked. Computerized control of the compressed air is desired if the transporter 1 is docked at a fixed station. The compressed air is fed through ports 5, 9, and 10 in the service tower 3.

The service tower 3 has a removable cover 4. Compressed air from the tow boat 24 is fed to the transporter 1 through a flexible hose 13 to ports 5, 9, and 10, and individually fed to the air chamber 12, the bladder liner 14, and the hull 2. The volume of air to be injected into the transporter 1 depends on the product being transported inasmuch as different products have different weights. Also, when the hull 2 is carrying a different product than the bladder liner 14, the product mix is dependent upon the user's preferences as to how much of each is carried.

The product to be carried by the bladder liner 14 is preferably a liquid injected through the bladder liner liquid fill and empty port 11. Product to be carried by the hull 2 by way of the hull liquid fill and empty port 6 or hull manhole 7. The fill and empty lines 6 and 11 are flexible and ribbed so as not to collapse. The hull manhole 7 and the bladder manhole 8 pass through the air chambers 12 and may be used for manual inspection of the bladder 14 and hull 2 as needed. Also, solid products can be loaded by gravity through the hull manhole 7 or bladder manhole 8. These solids can be unloaded through their respective manholes 7, 8 by vacuum suction.

The transporter 1 of FIGS. 1, 2, and 3, is designed to be submerged to sea level or below sea level to minimize surface interference. The stabilizing fins 17 affixed to the hull 2 provide stability while being towed. While being towed, it is often advisable to tow the transporter 1 slightly below the water level to reduce surface turbulence and contact with the wake of the towing boat. This is accomplished by controlling the stabilizing fins 17 operated by internal electric motors from controls in the tow boat.

FIG. 1 is a top view of the invention. A lateral support curtain 30 is included in the hull 2 as shown to prevent overloading to maintain draft. It is made of the same material as the exterior hull, but is not as thick. It has openings 31 in it for the passage of workers for inspections and repairs.

Exterior ballast/buoyancy cells 27 are positioned along the hull to add stability to the Transporter 1 from water turbulence and adjust buoyancy. They also act as a pneumatic fender to reduce or eliminate damage or punctures to the main container thus giving it a double hull advantage. Preferably, each ballast/buoyancy cell 27 is separated into compartments (each about 25' long, depending on the length of the entire unit) for added safety in the event one becomes punctured. Each cell 27 can be inflated with either water or air or both via lines 28 in communication with each. The lines 28 are controlled by electronic valves 29 operably associated with the service tower 3.

The regulation of the volume of air or water inflating each ballast/buoyancy cell 27 is controlled by computers on the towing vessel or the attending or docking station to maintain the system at the desired depth. Increased stability is afforded by the air chamber 12 as discussed above.

This embodiment may include a modified hull port 5 opening leading directly into the transporter 1 interior, which when uncovered, allows water and petroleum spillage to enter and fill the hull via gravity by regulating the depth of the transporter 1 via the cells 27. Any scavenger water that enters while filling can be removed from the hull via the empty port 6 and, if not advisable to return to the body of water it came from, can be put into a bladder liner 14 via the bladder liner fill and empty ports 11 for later removal. In the event the transporter 1 units are for single purpose use of bladder liners 14 may be eliminated.

Figure 4:
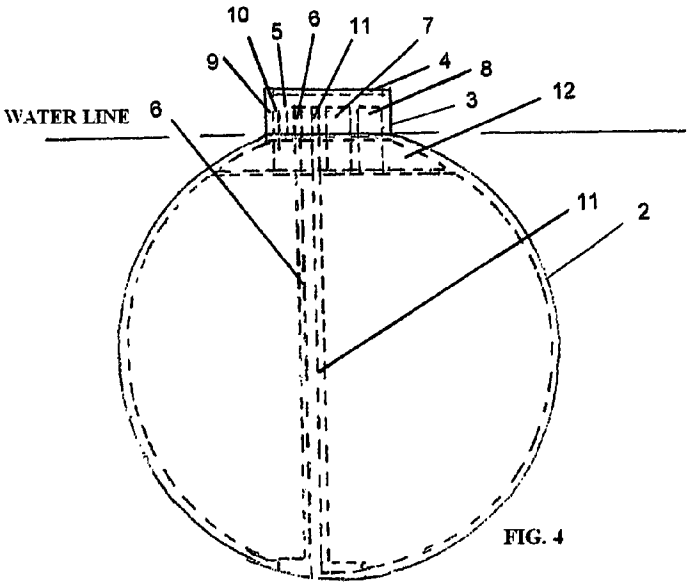
FIG. 4 is a front view of a water level and/or subs surface embodiment of a storage container.
Figure 5:
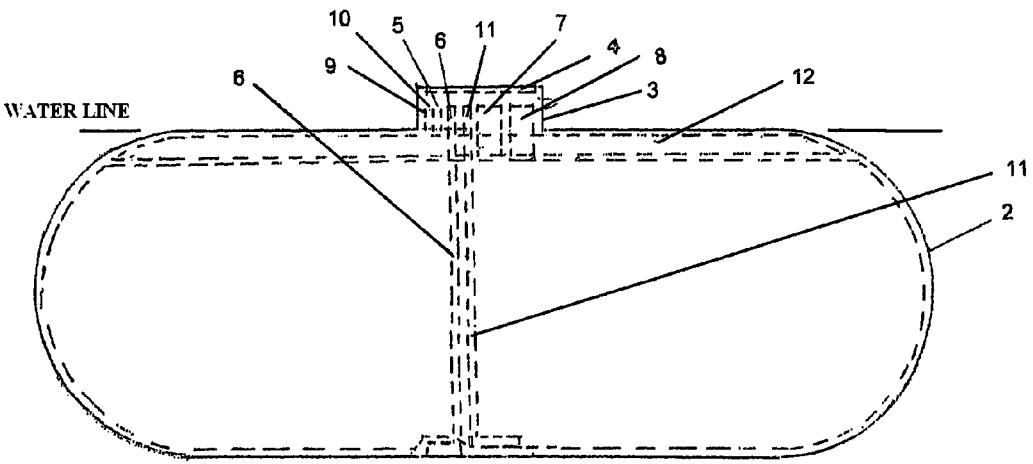
FIG. 5 is another side view of an embodiment of a storage container.

FIGS. 4 and 5 disclose various storage container units similarly constructed to the transporter 1, but without a longitudinal cable 15 and towing eye 18, optional curtain 30, and front tow 16. These storage container units shown in FIGS. 4 and 5 are used for storing product unloaded from the transporter 1 or other vessels or onshore facilities to provide a means for storing high volumes of product. By utilizing bladder liners 14 two or more products can be stored simultaneously. Also, the bladder liner 14, in many cases, eliminates the need for clean out when changing products. If the user is a single purpose user, the bladder liner 14 may not be necessary. For example, if the user wants only potable water storage that is delivered to the location, there is no need for a bladder liner 14. The storage container units of FIGS. 4 and 5 eliminate the need for costly and time consuming construction work necessary to support land based storage facilities or to satisfy temporary needs.

FIGS. 4 and 5 show two different designs for the storage container units. FIG. 4 illustrates a round 50' diameter shaped hull 2 to be used where storage depth is not limited. FIG. 5 illustrates an oblong storage container unit for use in shallower water. The oblong storage unit of FIG. 5 has a hull 2, which is 50' in diameter by 150' in length. Both designs are intended to be delivered to location by air and/or truck to be placed in position by crane.

Both storage container units of FIGS. 4 and 5 are to be submerged such that the hull is below water level or lower as shown for the water to provide exterior lateral support. The hull 2 is constructed of 3 or 4 ply rubber or plastic coated cord or canvas or a combination of both and may be plasticized lined Its bladder liner 14 is 2 or 3 ply rubber or plastic coated cord or canvas or a combination of both and may be plasticized lined. The bladder liner 14 has an air chamber 12 at the top to keep the storage container unit upright and level. The air chamber 12 and the bladder liner 14 are designed to be manually or computer controlled individually with compressed air to be supplied by a docking station.

Computerized control of the compressed air is recommended. The compressed air is similarly fed through ports 5, 9, and 12 in the service tower 3. Product entering the hull is fed through hull liquid fill and empty port 6 in the service tower 3. The service tower is secured with a cover 4. Solid product for the hull may also be gravity fed through the hull manhole 7 and is unloaded by use of vacuum suction. Product entering the bladder liner 14 is fed through the bladder liquid fill and empty port 11. Use of the bladder liner 14 for solid products is discouraged. The fill and empty lines 6 and 11 are flexible and ribbed so as not to collapse. The hull manhole 7 and the bladder liner manhole 8 are in communication with the air chamber 12 and may be used to manually inspect the bladder liner 14 and hull 2 as needed.

If the storage container units are to rest on the floor of a body of water, the bottom of the hull 2 may be reinforced to prevent perforation.

Figure 6:
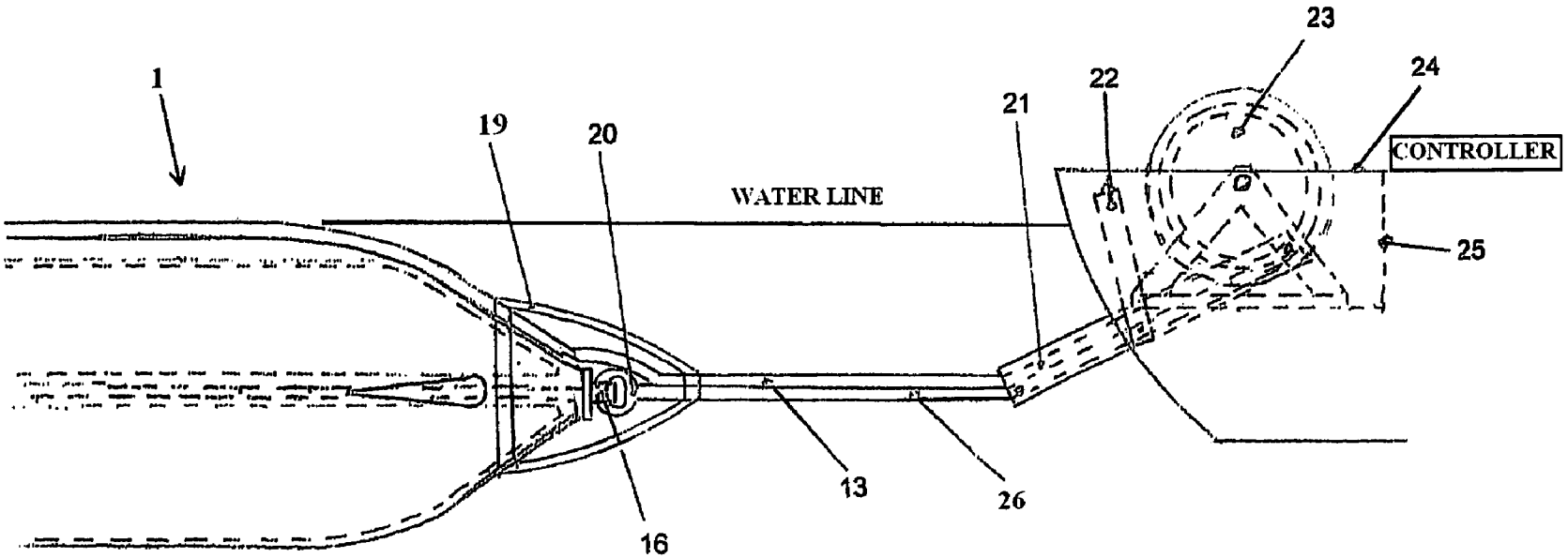
FIG. 6 is a side view of a towing and attachment arrangement for a transporter embodiment.

FIG. 6 illustrates the method of towing and the front part of the transporter 1. The water level of the body of water is level to the top of the transporter hull 2. The rear section of the tow boat 24 is constructed to have a well 25 that will contain an electrically controlled drum 23, with stored towing cable 26 that releases the towing cable 26 to the proper length. An hydraulic hitch arm positioner 22 operates the hitch positioner 21 to adjust the level of tow cable 26. The drum 23 has the tow cable 26 stored on it, which is attached to the automatic hitch 20 attached to the hull 2. A hitching guide 19 is included and may be structured as a deflector for protection of the hull at its forward towing end by deflecting water around the front of the hull 2 to prevent its distortion.

The tow cable 26 is associated with the air supply 13 from the tow boat shown as a hose. The rear end of the hull 2 has a towing eye 18 attached to the rear of the rust proof steel cable 15 for towing additional units.

The invention thus provides a lightweight towed submerged water transporter and storage system for liquids and solids, which employs internal lateral support curtains, and exterior ballast/buoyancy cells positioned to act as a pneumatic fender along a lightweight longitudinally reinforced hull with optional air and liquid storage bladders used not only to adjust buoyancy, but to allow the simultaneous transport of different solids and liquids for unloading or storage at a delivery point or on a back haul without cross-contamination.

The above description and specification should not be construed as limiting the scope of the appended claims. The claims themselves recite those features deemed essential for the invention.

I claim:

1. A water level and/or sub surface water transporter and storage system for liquids and solids comprising:

a. a towable fillable submergible streamlined ellipsoid shaped transporter hull with an interior with forward and rear towing attachment ends, a top with an air chamber, which when filled with air keeps the transporter upright and level during transport and provides rigidity for transport, fill ports and emptying ports in communication with the hull interior structured to fill the interior with air, solids, and liquids and then emptied from docks and/or surface vessels; said hull constructed of a material, which is collapsible, when empty, for lightweight transport in a transport mode, b. longitudinal ballast/buoyancy cells associated with the exterior of the hull, which are inflatable with gases or liquids to adjust buoyancy for the submerged transporter to be towed at a desired depth and act as pneumatic fenders c. a cordlike connecting spine passing through the hull to connect the towing attachment ends to provide longitudinal reinforcement to prevent longitudinal hull distortion during towing transport, d. surface towing vessel filling and emptying means associated during towing with the hull fill ports and emptying ports to inject air or gases, and e. a controller mounted on the surface towing vessel associated with the surface towing vessel filling and emptying means to adjust the air or gases in the bladders, ballast/buoyancy cells, and hull of the transporter to the required rigidity and buoyancy to tow the transporter at a desired speed and depth during transport mode, and to position and store the transporter at a desired storage location in a storage and/or unloading mode.

2. A water level and/or sub surface water transporter and storage system for liquids and solids according to claim 1, including stabilizing fins controlled by the controller attached exterior to the hull to interact with a hull slip stream to alter the depth and the angle of the transporter to provide stability during towing.

3. A water level and/or sub surface water transporter and storage system for liquids and solids according to claim 1, wherein the hull is constructed of rubber or plastic coated cord or canvas with a plasticized lining.

4. A water level and/or sub surface water transporter and storage system for liquids and solids according to claim 1, including an internal lateral support curtain secured within the hull structured to limit the amount of loading to insure that a desired draft is maintained, when filled.

5. A water level and/or sub surface water transporter and storage system for liquids and solids according to claim 1, including at least one optional fillable bladder liner structured to fit within the submergible ellipsoid shaped hull and not interfere with the connecting spine constructed of a material which holds either solids or liquids in a fill mode, and is collapsible, when empty, for cleaning in a cleaning mode.

6. A water level and/or sub surface water transporter and storage system for liquids and solids according to claim 1, including an openable inspection manhole in the hull and bladder liners for manual inspection for damage, and structured for optional open water gravity filling of the hull and bladder when the submersible transporter and storage system is lowered to position the manhole below water surface level.

7. A water level and/or sub surface water transporter and storage system for liquids and solids according to claim 1, including a storage container unit for receiving and storing liquids and solids from the transporter or dock comprising:

a. an inflatable hull with one or more fillable bladder liners structured to carry different liquids and solids within the hull without cross contamination and avoid the need to clean out the hull when changing products each with a top air chamber, which when filled with air keeps the container upright and level with the hull and bladder liner positioned below water to equalize pressure and provide rigidity; and fill ports and emptying ports structured to be filled with air, solids, and liquids and then emptied from dock stations and/or surface towing vessels; said hull and bladder liners constructed of a material, which holds either solids or liquids, and b. a loading station controller associated with a supply of air, solids and liquids and the fill ports and emptying ports to fill and empty and maintain the hull, ballast/buoyancy cells, and/or bladders at a required rigidity and weight for storage in a storage mode, and empty the hull and/or bladders in an emptying mode.

8. A water level and/or subsurface water transporter and storage system for liquids and solids according to claim 1, including towing deflection means associated with the forward attachment end to deflect water around the front of the hull when towed to prevent its distortion.

9. A submersible transporter system for liquids and solids comprising:

a. a plurality of towable submergible streamlined ellipsoid shaped inflatable hulls with front and rear towing attachment ends, each having:

i. one or more finable bladder liners mounted within the hull and structured to carry different liquids and solids without cross contamination and avoiding the need to clean out the hull when changing products, each with top air chambers, which when filled with air keeps the storage container upright and level; with the bladder liners positioned below water to equalize load pressure and provide rigidity;

ii. fill ports and emptying ports;

iii. a cordlike connecting spine passing through the hull and the insertable bladder liners to connect the towing attachment ends to provide longitudinal reinforcement to prevent longitudinal hull distortion during towing transport; said hull and bladder liners constructed of a material, which holds either solids or liquids;

b. longitudinal ballast/buoyancy cells associated with the exterior of the hulls, which are inflatable with air/gases or liquids to adjust buoyancy and act as pneumatic fenders, c. an internal lateral support curtain secured within the hull structured to limit the amount of loading to insure that a desired draft is maintained, when filled, and d. a loading station controller associated with a supply of air, liquids and solids and the fill ports and emptying ports to fill the inflatable hull, ballast/buoyancy cells, and bladder liners at a required rigidity and weight for storage buoyancy in a filling mode, and empty the hull and bladder liners in an emptying mode.

10. A submersible transporter system for liquids and solids according to claim 9, wherein the hull and bladder liners prior to filling with liquids and solids are filled with surrounding ambient liquids, which are then displaced during loading of the liquids and solids to maintain rigidity and shape of the hull and bladder liners during emptying and filling.

11. A submerged transporter system for liquids and solids according to claim 9, including stabilizing fins controlled by the controller attached exterior to the hull to interact with a hull slip stream to alter the depth and the angle of the transporter to provide stability during towing.

12. A submersible transporter system for liquids and solids according to claim 9, wherein the hull is constructed of rubber or plastic coated cord or canvas with a plasticized lining.

13. A submersible transporter system for liquids and solids according to claim 10, wherein the bladder is constructed of rubber or plastic coated cord or canvas.

14. A submersible transporter system for liquids and solids according to claim 9, wherein the hull and bladder liner are collapsible, when empty for light weight transport.

15. A submersible transporter system for liquids and solids according to claim 9, including deflection means for protection of the hull at its forward towing attachment end to deflect water around the front of the hull to prevent its distortion.

16. A submersible transporter system for liquids and solids according to claim 9, including openable inspection manholes in the hull and bladder liner for manual inspection of the hull and bladder liner in an inspection mode; and loading or unloading of liquids and solids in a loading/unloading mode.

17. A submersible transporter system for liquids and solids according to claim 9, comprising:

a. an inflatable hull and/or bladder each with a top air chamber, which when filled with air keeps the system upright and level with the hull and/or bladder positioned below water to equalize pressure and provide rigidity; and a fill port and an emptying port; said hull and/or bladder constructed of a material, which holds either solids or liquids, and b. a loading station controller associated with a supply of air, liquids and solids and the fill ports and emptying ports to fill the hull, ballast/buoyancy cells, and/or bladder at the required rigidity and weight for transit or storage in a transit or storage mode, and empty the hull, ballast/buoyancy cells, and/or bladder in a emptying mode.

18. A submersible transporter system for liquids and solids according to claim 9, wherein the hull and/or bladder liner prior to filling with liquids and/or solids are filled with surrounding ambient liquids, which are then displaced during loading of the liquids and solids to maintain rigidity and shape of the hull and bladder liner during loading and emptying.

19. A submersible transporter system for liquids and solids according to claim 9, including:

a dock for storing, loading, and unloading the inflatable hulls.

* * * * *